US006879107B2

(12) United States Patent
Hirano et al.

(10) Patent No.: US 6,879,107 B2
(45) Date of Patent: Apr. 12, 2005

(54) PLASMA DISPLAY PANEL AND FABRICATION METHOD OF THE SAME

(75) Inventors: Toshiaki Hirano, Tokyo (JP); Ken Itoh, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/192,731

(22) Filed: Jul. 11, 2002

(65) Prior Publication Data

US 2003/0030377 A1 Feb. 13, 2003

(30) Foreign Application Priority Data

Jul. 18, 2001 (JP) ..... 2001-218510

(51) Int. Cl.[7] ..... H01J 17/49
(52) U.S. Cl. ..... 313/587; 313/586
(58) Field of Search ..... 313/586, 502, 313/503, 504, 505, 506, 507, 587

(56) References Cited

U.S. PATENT DOCUMENTS 5,952,137 A * 9/1999 Ihara et al. ..... 430/27
6,525,471 B1 * 2/2003 Bachmann et al. ..... 313/587

FOREIGN PATENT DOCUMENTS

JP 9-295894 A 11/1997
JP 10-291854 A 11/1998
JP 2000-63171 A 2/2000

OTHER PUBLICATIONS

JP Patent 10–291854 English Abstract (Takeyoshi).*

* cited by examiner

*Primary Examiner*—Edward J. Glick
*Assistant Examiner*—Elizabeth Keaney
(74) *Attorney, Agent, or Firm*—Sughrue Mion, PLLC

(57) ABSTRACT

A protection film for protecting a dielectric layer of an AC type PDP is formed such that impurity metal ion densities of the protection film of the PDP, which is aged, become 400 ppm or less, respectively, and the protection film contains three or more hydrogen atoms assuming that the total number of atoms of the protection film is 100.

4 Claims, 4 Drawing Sheets

FABRICATION FLOWCHART OF COLOR PDP

PLASMA DISPLAY PANEL AND FABRICATION METHOD OF THE SAME

BACKGROUND OF THE INVENTION

1. Field of the Invention

The present invention relates to a plasma display panel (PDP) having a protection film for protecting a dielectric layer of the PDP from discharge and a fabrication method of the same plasma display panel and, particularly, the present invention relates to a plasma display panel having a magnesium oxide (MgO) protection film for improving discharge characteristics of the plasma display panel and a fabrication method of the same.

2. Description of the Prior Art

In general, the plasma display panel (PDP) is featured by thin structure, flicker-free display, high display contrast ratio, possibility of providing a relatively large display screen, short response time and self-light emission type with which a multi-color display can be realized by using various phosphor materials, etc. Therefore, the PDP is becoming popular in the field of color image display, which is related to computers.

The PDP is classified to an AC type PDP and a DC type PDP. In the AC type PDP, a protection film for preventing a dielectric layer formed in cells of the PDP from being damaged by discharge is provided. Requirements of a material of the protection film of the PDP for protecting the dielectric layer thereof from electric discharge are (1) high durability against ion bombardment, (2) high secondary electron emission coefficient and (3) high insulating characteristics. The protection film is generally formed of magnesium oxide (MgO), which satisfies those requirements. The MgO protection film is generally vapor-deposited on a PDP substrate by heating and sublimating MgO particles as a material by using electron beam (EB) vapor-deposition or formed by MgO ion plating (IP).

JP 2000-63171A and JP H10-291854A disclose fabrication methods of a MgO protection film of a PDP, in which impurity metal ion density of a MgO material is lowered to lower firing voltage of the PDP.

Although the definition of the firing voltage is not described in JP 2000-63171A, JP H10-291854A discloses the evaluation method of the discharge start voltage (cf. paragraph 0037 of the specification thereof and FIG. 2 of the drawings thereof). According to the evaluation method disclosed therein, the firing voltage of the PDP is monitored by increasing a voltage applied between surface discharge electrodes of the PDP.

However, the inventors of the present invention have found that, according to the evaluation method using the firing voltage as described in the above mentioned prior arts, an evaluation result obtained in a case where the evaluation is performed after the aging of the PDP, that is, in a constant cycle from sustaining discharge through priming to write discharge, that is, under conditions of the practical use of the PDP and an evaluation result obtained according to the disclosed prior art methods, which use the mere comparison of a firing voltage becomes different. That is, the present inventors have found that, according to the prior art evaluation method, the difference of firing voltage due to difference in impurity density between the deposition materials can not be found when the aging time of the PDP exceeds 20 hours even if there is a difference in priming voltage between the materials.

Therefore, the conventional evaluation method of the MgO protection film is meaningless in evaluating the priming voltage of the practical PDP. Accordingly, it is impossible to obtain a MgO protection film having a low priming voltage by merely defining the metal ion density of the deposition material of the MgO protection film.

Furthermore, although, in evaluating the drive characteristics of a PDP, it is necessary to once reset a sustaining discharge of the whole area of the PDP by a priming discharge, to lighten the whole area and then to darken the whole area by a priming erase, it is difficult to uniformly reset the sustaining discharge by a low priming voltage since the priming voltage of the conventional protection film is high. If the uniform resetting of the sustaining discharge is impossible, there may be erroneous lightening or flicker. Although it is possible to uniformly reset the sustaining discharge by increasing the priming voltage, high priming voltage may produce large discharge, resulting in that the luminance due to priming, that is, black luminance, is increased and contrast is lowered.

It has generally known that the impurity metal ion density of the MgO protection film formed by the electron beam vapor deposition is increased compared with the metal ion density of the MgO deposition material of which the MgO protection film is formed. However, the present inventors have found that it is possible to restrict the increase of the impurity metal ion density of the MgO protection film by forming the MgO protection film of the MgO material in a hydrogen ion environment.

Incidentally, in order to improve the orientation of the MgO film, JP H9-295894A discloses a method for forming a MgO film in an environment containing exited or ionized hydrogen atoms. However, in the film forming method disclosed therein, the orientation plane is not constant although the orientation itself is improved. Therefore, there may be cases where the sputtering durability characteristics of the MgO protection film becomes insufficient. Moreover, the crystal grain size of the MgO film becomes smaller and the firing voltage becomes higher.

SUMMARY OF THE INVENTION

The present invention was made in view of the described problems of the prior arts and has an object to provide a plasma display panel having a protection film for lowering the priming voltage and improving the contrast thereof and a method for fabricating the same plasma display panel.

Another object of the present invention is to provide a plasma display panel having a protection film for lowering the priming voltage, which is capable of driving with low priming voltage and of performing a high contrast display without erroneous lightening or flicker by performing a uniform resetting of the panel with the low priming voltage.

The present invention is featured by that an increase of impurity in a protection film (MgO film) is restricted to, for example, 400 ppm or less, by forming the protection film with a highly pure film material in a hydrogen ion environment. With such feature of the present invention, it is possible to lower the priming voltage in driving a PDP after aged to thereby improve the contrast of display thereof.

According to the present invention, the plasma display panel is featured by that, in the protection film for protecting a dielectric layer of the PDP from discharge, impurity metal ion density of the protection film after the PDP is aged is 400 ppm or less and contains three or more hydrogen atoms under assumption of the number of whole atoms being 100.

The protection film is preferably a MgO film. The impurities contained in the MgO film are Na, Al, K, Ca, V, Cr, Mn, Fe, Co, Ni, Cu and/or Zn. The MgO film preferably has conductivity of $1\times10^{-11}$ S/cm or less.

Furthermore, according to the present invention, a fabrication method of a plasma display panel is provided, which is featured by comprising the film-forming step of forming a protection film for protecting the dielectric layer of the PDP from discharge on a panel substrate in an environment containing excited or ionized hydrogen while heat-treating such that the impurity metal ion density of the protection film after the PDP is aged becomes 400 ppm or less.

It is preferable that the film-forming step is performed with temperature of the panel substrate being 200° C. to 250° C. Further, the film-forming step may be performed by using electron beam vapor-deposition, sputtering or ion plating.

DETAILED DESCRIPTION OF THE PREFERRED EMBODIMENTS

Embodiments of the present invention will be described in detail with reference to the drawings.

Figure 1:
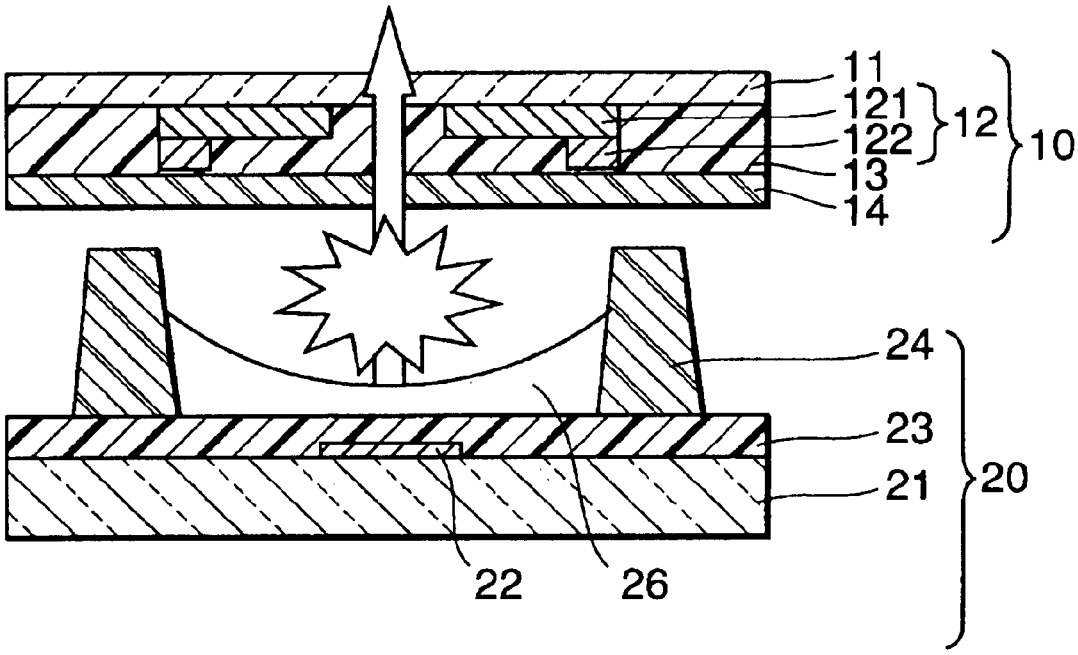
FIG. 1 is a cross section of a light-emitting cell, which is a basic unit pixel of an AC type color PDP according to the present invention.

FIG. 1 is a cross section of a light-emitting cell, which is a basic unit pixel of an AC type color PDP according to the present invention. As shown in FIG. 1, the PDP has a front substrate 10 and a rear substrate 20 arranged in parallel to the front substrate 10 with a predetermined gap.

The front substrate 10 is composed of a glass substrate 11 and a discharge-sustaining electrode 12 provided on the glass substrate 11. The discharge-sustaining electrode 12 includes a transparent electrode 121 and a bus electrode 122 in the form of a metal film and is covered by a transparent dielectric layer 13 for AC drive. A protection film 14 in the form of a MgO film 1 $\mu$m thick is formed on a surface of the dielectric layer 13.

Figure 2:
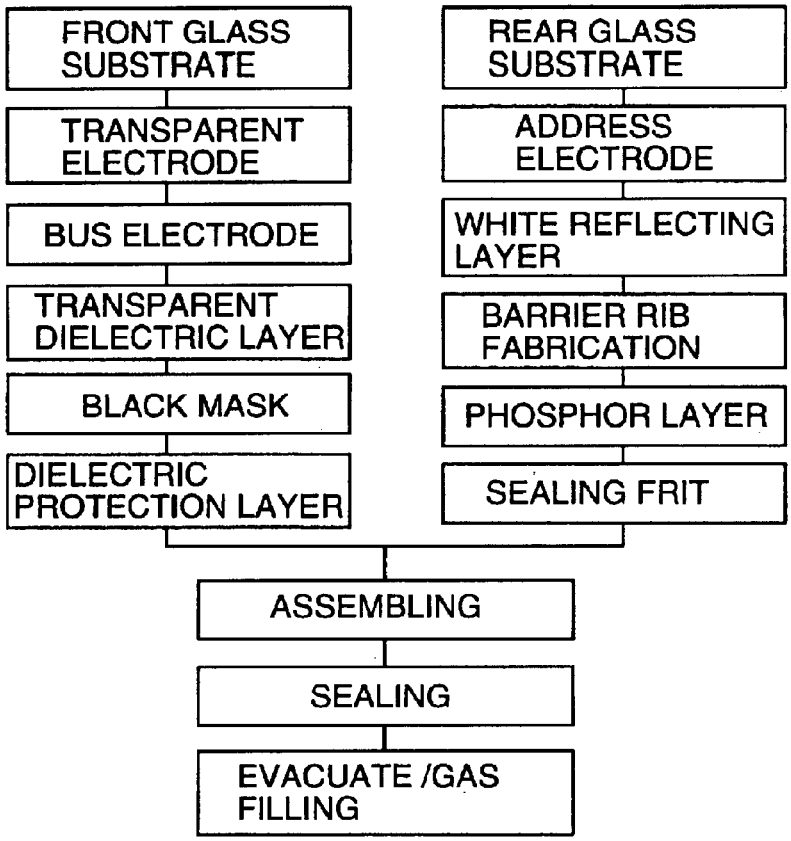
FIG. 2 is a flowchart showing a fabrication method of the color PDP according to the present invention.

On the other hand, the rear substrate 20 is composed of a glass substrate 21 and an address electrode 22 provided on the glass substrate 21. An underlying layer 23 formed of a dielectric material is formed to cover the address electrode 22. A barrier rib 24 for defining color light emission of the PDP is provided on the underlying layer 23 and a phosphor layer 26 is formed to cover the barrier rib and the dielectric layer. A peripheral portion of the gap between the front and rear substrates 10 and 20 is sealed by a seal member, which is not shown, and the color PDP is completed by evacuating cells and then filling them with discharge gas. FIG. 2 shows an assembling flowchart of the PDP.

The protection film 14 on the side of the front substrate 10 has a function of protecting the dielectric layer 13, which should be directly exposed to plasma in the cell if there were no such protection film, against ion bombardment to thereby prevent the dielectric layer 13 from being damaged. In addition to this function, the protection film 14 has functions of emitting secondary electrons for gas discharge when a voltage applied between the electrodes and of providing insulation high enough to accumulate and hold wall charges. Among others, the function of providing high insulation is important in lowering a firing voltage and in obtaining short response time of the PDP.

By forming the MgO protection film 14 of high purity MgO deposition material in hydrogen ion environment, it becomes possible to restrict increase of impurity in the Mgo protection film to 400 ppm or less and, consequently, to lower the priming voltage in driving the well aged PDP to thereby improve the contrast of a display thereof.

This MgO protection film can be fabricated by using a conventional film-forming device. For example, when a MgO protection film having thickness in a rage from 500 nm to 1500 nm is formed under conditions of inside pressure of a chamber of the conventional film-forming device in a rage from $2.0\times10^{-2}$ Pa to $4.0\times10^{-2}$ Pa, partial pressure ratio of hydrogen to oxygen in an inside atmosphere of the chamber in a range from 0.3 to 1, substrate temperature in a range from 150° C. to 250° C. and vapor-deposition rate in a range from 100 nm/min to 200 nm/min, the number of hydrogen atoms in the MgO protection film can be made 3 to 10 under assumption that the total number of atoms of the MgO protection film is 100.

Since it is possible to prevent the substrate from being cracked by limiting the temperature thereof to a value not higher than 300° C., the upper limit of the substrate temperature is important. Incidentally, a preferable substrate temperature is in a range from 200° C. to 250° C.

The present inventors had performed MgO vapor-deposition by using three MgO deposition materials A, B and C having different impurity metal ion densities and had evaluated the panel drive voltage characteristics of the respective MgO materials. Table 1 shows the result of the evaluation.

TABLE 1

| | PANEL DRIVE VOLTAGE CHARACTERISTICS | | | |
|---|---|---|---|---|
| MgO MATERIAL | Vdsmin | Vdsmax | Vpcmin | Vpcmax |
| A | 149 | 185 | 245 | 328 |
| B | 100 | 198 | 282 | 395 |
| C | 153 | 187 | 259 | 352 |

Figure 3:
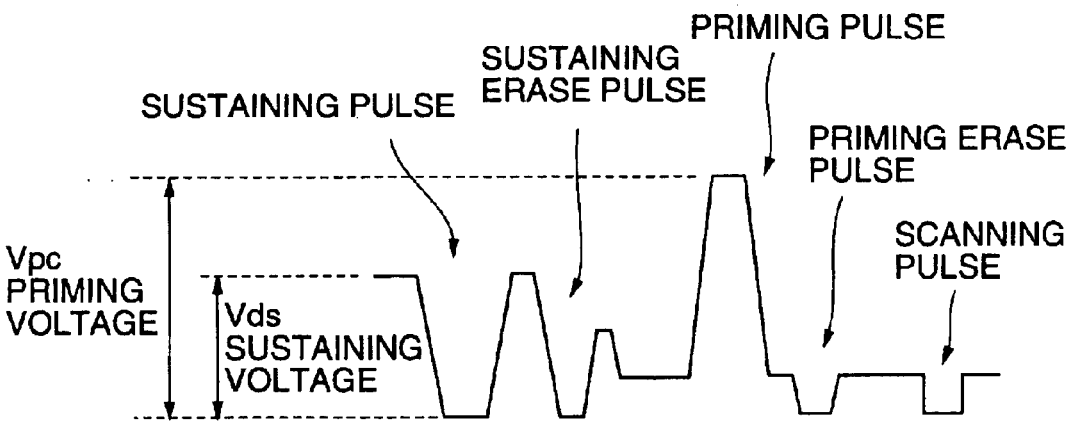
FIG. 3 shows a drive signal waveform used to drive the color PDP and obtain data shown in Table 3 for evaluating the drive characteristics of the plasma display panel.

FIG. 3 shows a drive voltage waveform of the PDP used for the evaluation of the drive characteristics. Vdsmin in Table 1 represents a minimum value of the surface discharge sustaining voltage Vds with which a normal write is possible without erroneous lightening and Vdsmax represents a maximum value of the surface discharge sustaining voltage Vds with which a normal write is possible.

Vpcmin is a minimum value of a priming commence voltage Vpc at which the priming discharge is initially produced in a PDP display plane. Vpcmax is a maximum value of a priming completion voltage Vpc, which is a minimum voltage generated uniformly in the whole PDP display plane without abnormal write and erroneous lightening caused by the priming discharge. That is, the priming commence voltage Vpcmin is the voltage at which the priming discharge is generated in even only one cell in the panel plane and the priming completion voltage Vpcmax is a voltage at which the priming discharge is formed in the whole panel plane. In the latter case, there is no abnormal write and erroneous lightening in the whole display panel plane.

The term "priming" means a pre-discharge for accumulating wall charges and is used as a drive method for stably commencing discharge with low voltage. Tables 2 and 3 show results of analysis of impurity metal ions in the MgO films formed of MgO deposition materials A, B and C used in this embodiment and in the MgO deposition materials A, B and C, respectively.

TABLE 2

| MgO | IMPURITY METAL ELEMENTS IN MgO FILM (ppm) | | | | |
|---|---|---|---|---|---|
| MATERIAL | Ca | Fe | Al | V | Cr |
| A | 269 | 193 | 172 | 3 | 8 |
| B | 6415 | 1756 | 1009 | 332 | 266 |
| C | 1470 | 334 | 226 | 108 | 79 |

TABLE 3

| MgO | IMPURITY METAL ELEMENTS IN MgO DEPOSITION MATERIAL (ppm) | | | | |
|---|---|---|---|---|---|
| MATERIAL | Ca | Fe | Al | V | Cr |
| A | 253 | 24 | 82 | 10 | 16 |
| B | 526 | 170 | 330 | 52 | 34 |
| C | 510 | 65 | 140 | 18 | 27 |

Figure 4:
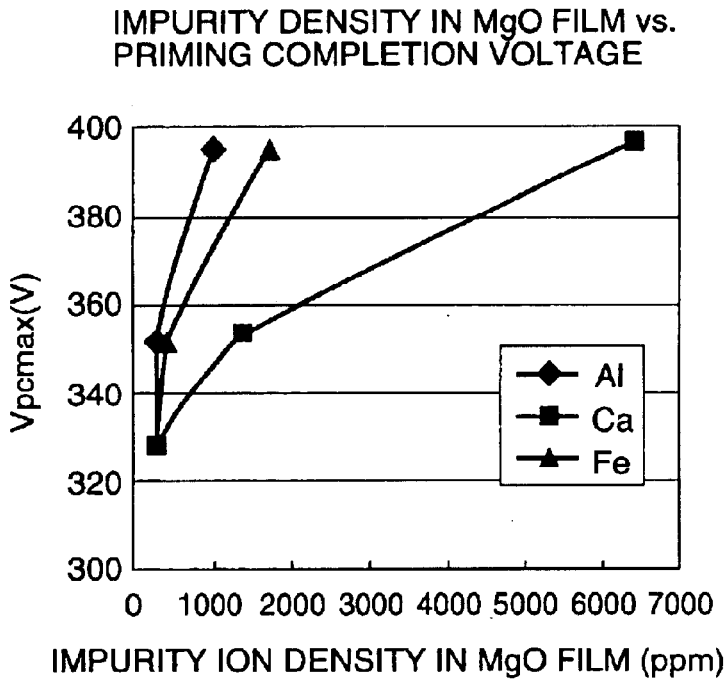
FIG. 4 is a graph showing a relation between impurity metal ion density in a MgO film and Vpcmax.

The impurity analysis was performed by using the flameless atomic absorption spectrometry (FLAAS). The FLAAS will be described in detail. First, a furnace having heat-generating element of graphite or heat-durable metal is electrically heated to dry and atomize MgO sample solution. Emission spectrum from exited atoms is obtained by irradiating the thus produced atomic vapor layer with light. In a case where atom in ground state is changed to excited state by absorbing light having a certain frequency and then returns to the ground state by emitting light having the same frequency, the transition is called as resonance transition and its spectral line is called resonance line. The resonance line depends upon the kind of atom and the density thereof in the atomic vapor-deposition layer is obtained on the basis of the intensity of its line spectrum. By preliminarily obtaining a calibration curve by using a sample having known impurity density, the impurity density of an aimed MgO sample can be obtained. The measurement was performed by dissolving the MgO film and the MgO material thereof in nitric acid ($H_2O:HNO_3$=9:1), respectively, and analyzing every metal atom of the respective solutions by using the flameless atomic absorption spectrometer (Varian SpectroAA-400Z). FIG. 4 shows relations between densities of ion Al, Ca and Fe as impurities in the MgO film in abscissa and Vpcmax thereof in ordinate.

From these relations, it is clear that the priming completion voltage of the PDP could be successfully reduced by 60 V or more by restricting the respective impurity metal ion densities in the MgO film to a value not larger than 400 ppm. The reason for this success will be described.

Figure 5:
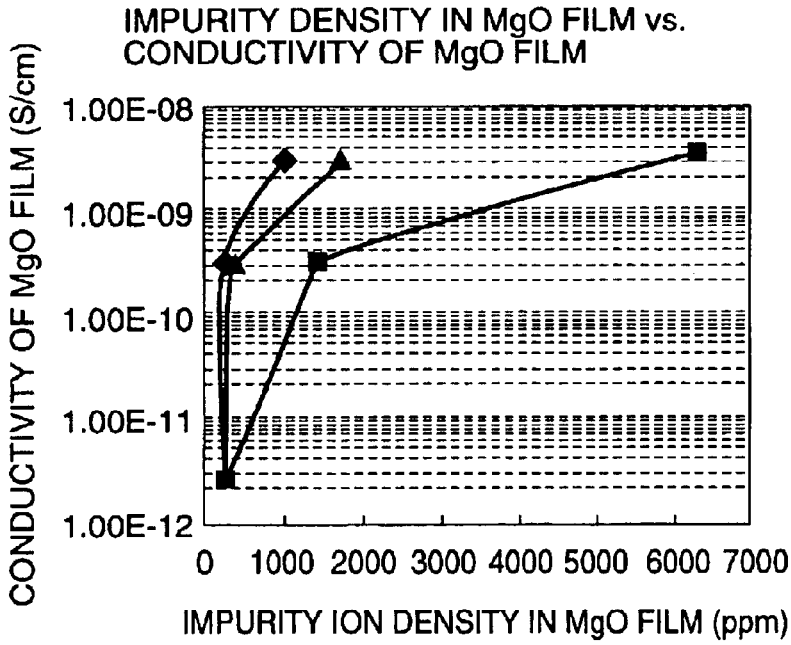
FIG. 5 is a graph showing a relation between impurity metal ion density in the MgO film and conductivity of the MgO film.

FIG. 5 shows relations between ion densities of Al, Ca and Fe in the MgO film and conductivity of the MgO film. It is clear from FIG. 5 that, since the conductivity of the MgO film is as small as $1\times10^{-11}$ S/cm in this embodiment, the insulation characteristics of the MgO film is improved, the formation of the wall charge due to the priming effect is made efficient and so the reduction of the drive voltage can be realized.

Figure 6:
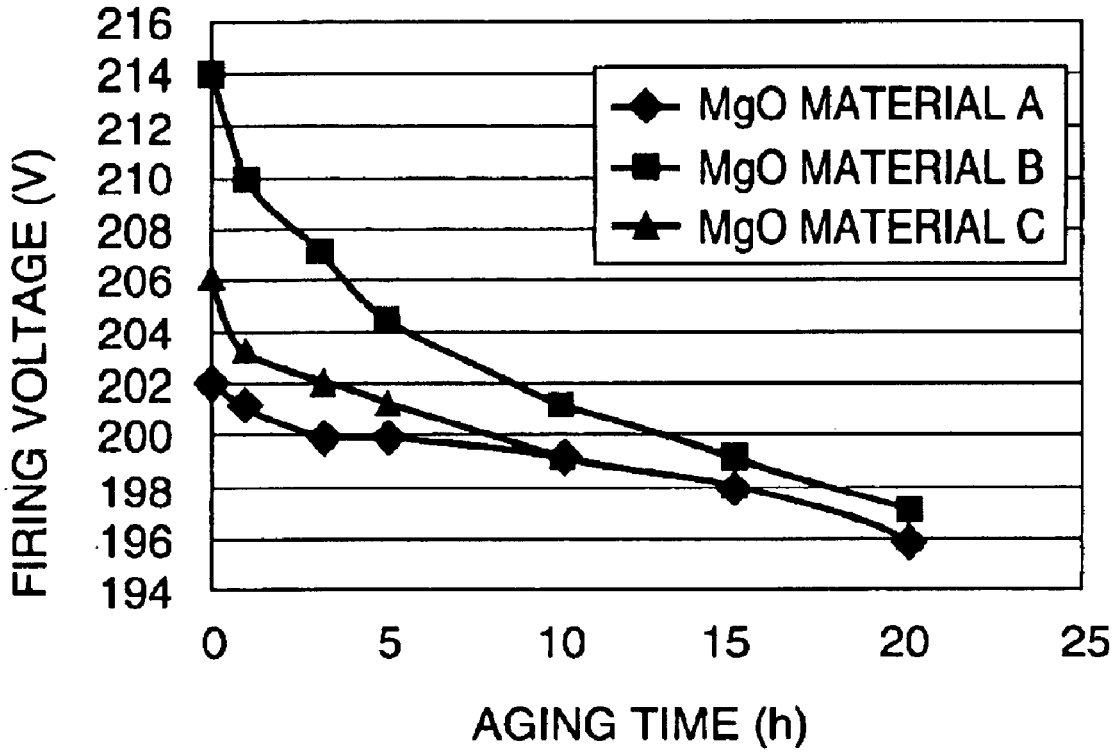
FIG. 6 is a graph showing a relation between aging time of the PDP and firing voltage.

FIG. 6 is characteristics curves showing relations between the aging time of the PDP and the firing voltage of the PDP having MgO films formed of the respective MgO materials A, B and C. From FIG. 6, it is clear that, when the aging time of the PDP exceeds 20 hours, the firing voltage becomes substantially identical regardless of the difference in impurity density between the MgO films, so that the conventional evaluation of the firing voltage, which is performed by the mere comparison of firing voltage, cannot be used as the evaluation measures. A supplementary description of the development of the present invention will be given below.

It has been empirically known that the priming voltage and the uniformity of resetting depend upon the quality of the protection film (MgO film) provided on the front substrate of the PDP. On the basis of the general knowledge, the present inventors have investigated the relation between the characteristics of the protection film and the priming voltage by conducting various experiments and found that the priming voltage becomes low when the ion densities of impurity metals, particularly, Ca, Fe, Al, V and Cr, of the protection film is low and the conductivity of the protection film are low when the metal ion densities are low.

On the basis of the thus obtained knowledge, the present inventors have studied for means for reducing the metal ion density in the protection film and found that, in order to reduce the metal ion density in the protection film, it is effective to reduce the impurity metal ion density of the material of which the protection film (MgO film) is formed and to perform the formation of the protection film by a heat-treatment thereof in a hydrogen ion environment, that is, an environment containing excited or ionized hydrogen.

It is necessary in this case that the PDP is evaluated on the priming voltage during a constant cycle of from sustaining discharge through priming to write discharge after the PDP having the front substrate on which a protection film is formed is aged. This evaluation is performed under the same conditions as those in the practical use of the PDP.

As described hereinbefore, according to the present invention, it is possible to restrict the increase of impurity ion density in the MgO film to a value not larger than 400 ppm by forming the protection film of a highly pure MgO material in a hydrogen ion environment. Therefore, it is possible to reduce the priming voltage of the PDP in driving the aged PDP to thereby improve the contrast.

What is claimed is:

1. A plasma display panel comprising: a first substrate having electrodes covered by a dielectric layer; a second substrate provided in an opposing relation to said first substrate; discharge gas sealed in a gap between said first substrate and said second substrate; and a protection film formed on said dielectric layer, said protection film functioning to protect said dielectric layer from discharge, ion densities of respective impurity metals contained in said protection film being 400 ppm or less and said protection film containing at least three percent hydrogen atoms where the total number of atoms contained in said protection film is 100 percent.

2. A plasma display panel as claimed in claim 1, wherein said protection film is a magnesium oxide film.

3. A plasma display panel as claimed in claim 2, wherein said impurity metal comprises at least one metal selected from the group consisting a Na, Al, K, Ca, V, Cr, Mn, Fe, Co, Ni, Cu and Zn.

4. A plasma display panel as claimed in claim 2, wherein a conductivity of said magnesium oxide film is $1\times10^{-11}$ and or Zn.

* * * * *